US010150020B2

(12) United States Patent
Cole et al.

(10) Patent No.: US 10,150,020 B2
(45) Date of Patent: Dec. 11, 2018

(54) GOLF CLUB HEAD WITH BACK CAVITY PROTRUSION

(71) Applicant: KARSTEN MANUFACTURING CORPORATION, Phoenix, AZ (US)

(72) Inventors: Eric V. Cole, Phoenix, AZ (US); Eric J. Morales, Laveen, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/435,005

(22) Filed: Feb. 16, 2017

(65) Prior Publication Data

US 2017/0239533 A1 Aug. 24, 2017

Related U.S. Application Data

(60) Provisional application No. 62/296,923, filed on Feb. 18, 2016.

(51) Int. Cl.

| | |
|---|---|
| ***A63B 60/04*** | (2015.01) |
| ***A63B 53/04*** | (2015.01) |
| *A63B 60/54* | (2015.01) |

(52) U.S. Cl.

CPC ..... *A63B 53/0475* (2013.01); *A63B 60/54* (2015.10); *A63B 2053/0416* (2013.01); *A63B 2053/0454* (2013.01)

(58) Field of Classification Search

CPC ..... A63B 53/0475

See application file for complete search history.

(56) References Cited

U.S. PATENT DOCUMENTS

| | | | | |
|---|---|---|---|---|
| 5,290,032 | A | 3/1994 | Fenton | |
| 5,549,297 | A | 8/1996 | Mahaffey | |
| 5,649,872 | A | 7/1997 | Antonious | |
| RE35,955 | E | 11/1998 | Lu | |
| 6,299,547 | B1 | 10/2001 | Kosmatka | |
| 6,454,665 | B2 | 9/2002 | Antonious | |
| 7,462,112 | B1 | 12/2008 | Sung | |
| 7,819,757 | B2 * | 10/2010 | Soracco | A63B 53/04 473/332 |
| 8,088,025 | B2 * | 1/2012 | Wahl | A63B 53/047 473/345 |
| 8,506,423 | B2 | 8/2013 | Oldknow | |
| 8,535,177 | B1 | 9/2013 | Wahl | |
| 8,777,777 | B2 | 7/2014 | Cole | |
| 9,162,119 | B2 | 10/2015 | Park | |
| 2010/0130303 | A1 | 5/2010 | Stites | |
| 2011/0201444 | A1 | 8/2011 | Stokke | |
| 2014/0295986 | A1 | 10/2014 | Gilbert | |

FOREIGN PATENT DOCUMENTS

| | | |
|---|---|---|
| WO | 2001038562 | 5/2001 |

OTHER PUBLICATIONS

Taylormade Rossa Agsi Putter Review, https://thesandtrap.com/b/clubs/taylormade_rossa_agsi_putters_review, Aug. 26, 2005.

* cited by examiner

*Primary Examiner* — Michael Dennis

(57) ABSTRACT

A golf club head including a body having a front portion, a rear portion, a toe portion, a heel portion, a top portion, and a bottom portion. The body further includes a cavity in the front portion. The cavity having a protrusion and a step configured to receive a strikeplate, such that a gap exists between the strikeplate and the inner surface of the cavity.

10 Claims, 2 Drawing Sheets

GOLF CLUB HEAD WITH BACK CAVITY PROTRUSION

CROSS-REFERENCE TO RELATED APPLICATIONS

This claims the benefit of U.S. Provisional Patent Application No. 62/296,923, filed on Feb. 18, 2016, the contents of which are incorporated fully by reference herein.

FIELD OF INVENTION

The present disclosure relates to golf clubs. In particular, the present disclosure relates to iron-type golf club heads with a floating perimeter face.

BACKGROUND OF THE INVENTION

In the game of golf, several types of golf clubs are used depending on the type of shot the golfer intends to perform. Iron-type golf clubs and wedge-type golf clubs are typically used for shots into the green, where the remaining distance is too short for a hybrid or wood-type golf club. Each iron and wedge in a set of golf club heads has a different loft that corresponds to the distance the golf ball flies when struck. A low loft corresponds to a longer distance, while a high loft corresponds to a shorter distance. Distance may also vary depending on where on the clubface the impact with the golf ball occurs. For example, a ball struck near the center of the clubface will fly further than a ball struck near the toe, heel, top, or bottom of the clubface. This variable distance can present a problem for golfers attempting to increase the accuracy and consistency of their golf shots onto the green. Accordingly, there is a need in the art for a golf club with features that result in a more consistent ball flight distance regardless of where on the clubface the ball impact occurs.

SUMMARY OF THE INVENTION

Described herein is a golf club head with a strikeface coupled to a front of the club head. The front includes a cavity defined by a perimeter. The perimeter includes a step down from a top surface of the perimeter that extends inwardly. The strikeface is in direct contact with a protrusion that extends from the front of the club head to a rear portion of the strikeface. The strikeface, in conjunction with the protrusion, prevents substantial deflection of the strikeface at the center. Accordingly, the characteristics of the strikeface can be tailored to provide a consistent ball flight distance throughout the entire surface of the strikeface. Methods of manufacture are also described below.

Figure 1:
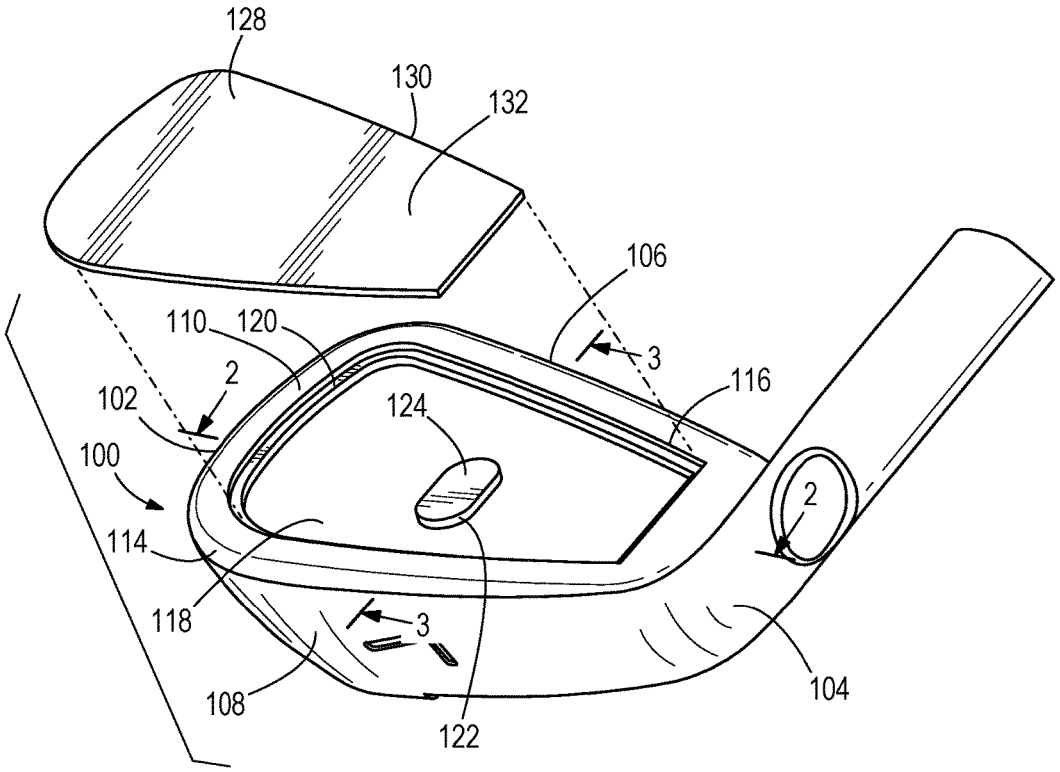
FIG. 1 illustrates an exploded view of an embodiment of an iron-type golf club with a floating perimeter strikeface.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure.

DETAILED DESCRIPTION

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 2:
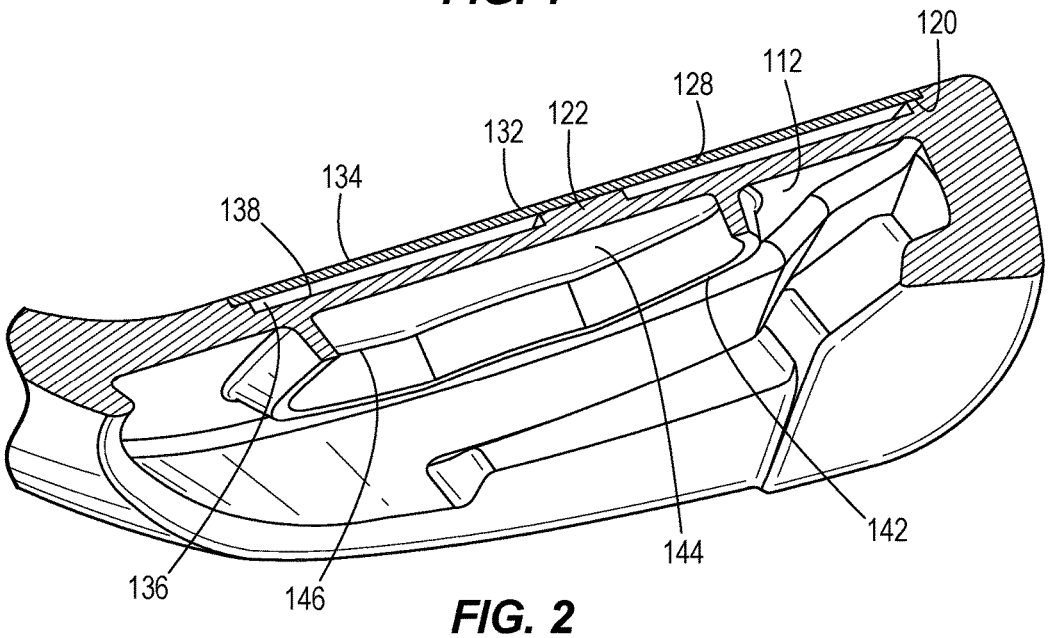
FIG. 2 illustrates a cross-sectional view of the golf club of FIG. 1 viewed from above.
Figure 3:
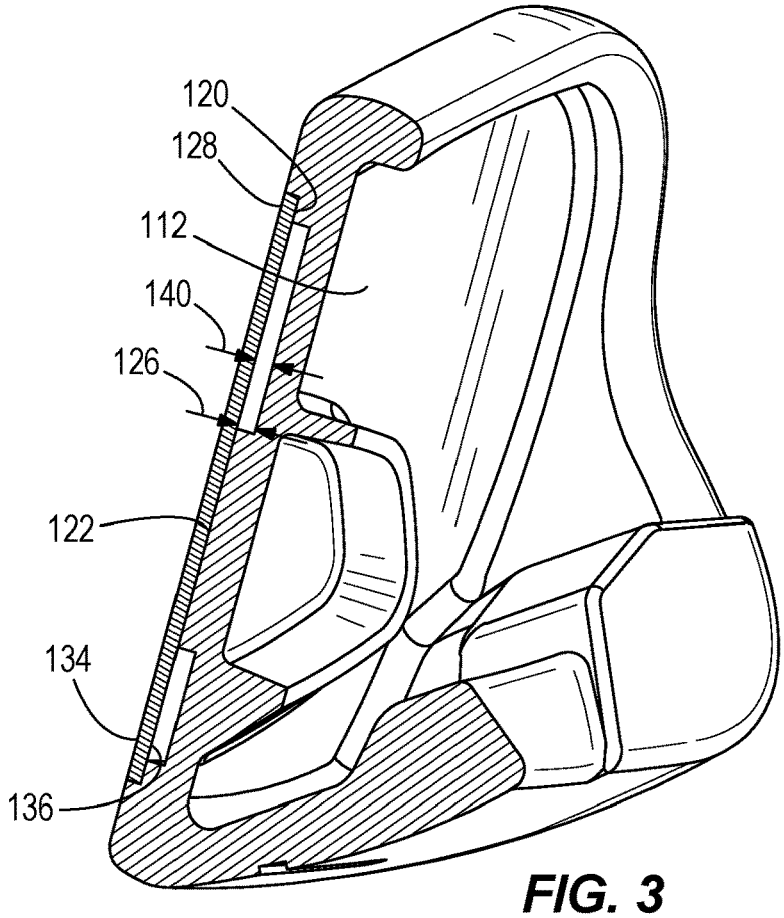
FIG. 3 illustrates a cross-sectional view of the golf club head of FIG. 1 viewed from the heel.

FIGS. 1-3 illustrate a golf club head 100 according to one embodiment of the present invention. Golf club head 100 can be an iron-type golf club head or a wedge-type golf club head. For example, in some embodiments, the golf club head 100 can have a loft angle of approximately 20 degrees to approximately 70 degrees. The golf club head is not limited in this regard. In many embodiments, golf club head 100 can include a toe portion 102, a heel portion 104 opposite the toe portion 102, a top portion 106, a bottom portion 108 opposite the top portion 106, a front portion 110, and a rear portion 112 opposite the front portion 110. Club head 100 may comprise titanium, titanium alloys, other titanium based material, steel, stainless steel, aluminum, aluminum alloys, plastic resins, composite materials or other suitable types of materials.

The front portion 110 of the golf club head 100 includes an outer surface 114 defining a perimeter 116 and a cavity 118 formed within the outer surface 114. The front portion 110 can further include a step 120, which steps down from outer surface 114 and extends inwardly to the cavity 118. Although step 120 is shown as a flat surface with square edges in the current embodiment, step 120 is not limited in this regard. For example, step 120 may comprise any cross-sectional shape, including, but not limited to, a triangle, rectangle, semicircle or any other geometric shape. The depth of the step 120 can be between 0.050 and 0.250 inches. The depth of the step 120 can be 0.050 inches, 0.075 inches, 0.100 inches, 0.125 inches, 0.150 inches, 0.175 inches, 0.200 inches, 0.225 inches, or 0.250 inches. The depth of the cavity 118 measured from the front portion 110 of the club head can be greater than the depth of the step located on the periphery portion of the cavity 118. The depth of the cavity 118 may vary or be consistent from the step periphery to the center of the cavity. A deeper cavity 118 can provide the center of gravity to be present further back in the club. The depth of the cavity 118 can be between 0.07 inches to 0.500 inches. The depth of the cavity 118 can be between 0.07 inches, 0.10 inches, 0.15 inches, 0.20 inches, 0.250 inches, 0.30 inches, 0.35 inches, 0.40 inches, 0.45 inches or 0.50 inches.

The front portion 110 also includes a protrusion 122 that extends upwardly from a bottom surface of the cavity 118 and has a top surface 124. The protrusion 122 comprises protrusion height 126, which is measured from front portion 110 to protrusion top surface 124. The protrusion 122 is illustrated as being shaped as an ellipse, however in other constructions, the protrusion 122 can be in the shape of a triangle, rectangle, circle or any other suitable geometric shape. Further, while the protrusion 122 is depicted as a single body, the protrusion 122 may include more than one body. In a construction with more than one body comprising the protrusion 122, the bodies may be oriented contiguous with other bodies or may be spaced apart from other bodies. In the present embodiment, the top surface 124 of the protrusion 122 is depicted as a flat, smooth surface, but in other embodiments, the top surface 124 may be uneven and/or textured. The height of the protrusion 122 is the depth of the cavity 118 minus the depth of the step 120 as the protrusion 122 sits flush or connects to the strikeface 128 described below. The height of the protrusion 126 can be between 0.02 and 0.45 inches. The height of the protrusion 126 can be 0.02 inches, 0.05 inches, 0.10 inches, 0.15 inches, 0.20 inches, 0.250 inches, 0.30 inches, 0.35 inches, 0.40 inches, or 0.45 inches.

The golf club head 100 comprises a center of gravity. Further, the golf club head 100 comprises a CG plane which extends in a general direction from the front portion 110 to the rear portion 112, is orthogonal to the strikeface 128, and intersects with the golf club head 100 center of gravity. In many embodiments, the protrusion 122 is positioned along the CG plane. The protrusion 122 can extend upwardly from the bottom surface of the cavity 118 at an equal distance from the step 120 nearest the toe portion 102 as from the step 120 nearest the heel portion 104. In other embodiments, the protrusion 122 can be positioned at an equal, a greater or a smaller distance from the step 120 nearest the toe portion 102 as from the step 120 nearest the heel portion 104. In some embodiments, the protrusion 122 can be positioned at an equal, a greater or a smaller distance from the step 120 nearest the top portion 106 as the step 1120 nearest the bottom portion 108.

In embodiments, wherein there is a plurality of protrusions 122, a geometrical center of the plurality of protrusions 122, defined as a point equidistant from the center of each of the plurality of protrusions 122, can be positioned along the CG plane. In other embodiments, the center of the plurality of protrusions 122 can be positioned at an equal, a greater or a smaller distance from the step 120 nearest the toe portion 102 as the step 120 nearest the heel portion 104. In some embodiments, the center of the plurality of protrusions 122 can be positioned at an equal, a greater or a smaller distance from the step 120 nearest the top portion 106 as the step 120 nearest the bottom portion 104. The mass or volume of the protrusions 122 positioned around the geometrical center of the plurality protrusions can be adjusted to manipulate the club head 100 CG. For example, the volume and/or mass of the protrusions 122 positioned above the geometrical center of the plurality of protrusions 122, can be equal to, greater than, or less than the volume and/or mass of the protrusions 122 positioned below the geometrical center of the plurality of protrusions 122. In some embodiments, the mass of the protrusions 122 below the geometrical center of the plurality of protrusions 122 can be greater than the protrusions 122 above the geometrical center of the plurality of protrusions 122, thereby moving the CG lower on the golf club head 100. For further example, the volume and/or mass of the protrusions 122 positioned between the heel portion 104 and the geometrical center of the plurality of protrusions 122, can be equal to, greater than, or less than the volume and/or mass of the protrusions 122 positioned between the toe portion 102 and the geometrical center of the plurality of protrusions 122.

Golf club head 100 further comprises a strikeface 128 configured to be coupled to the front portion 110. The strikeface 128 may comprise the same material as the rest of club head 100 or a different but suitable material. The strikeface 128 includes a strikeface perimeter 130, a center portion 132, a front surface 134, and a rear surface 136 opposite the front surface 134. The strikeface 128 may further include one or more grooves on the front surface 134. The strikeface 128 is configured to be coupled to the front portion 110 by connecting the rear surface 136 of the strikeface 128 to the step 120 surrounding the cavity 118 and connecting the rear surface 136 of the strikeface 128 to the top surface 124 of the protrusion 122. The strikeface 128 may be coupled to the front portion 110 by swaging, welding, brazing, adhesive, mechanical fit or any other method capable of coupling strikeface 128 to the front portion 110. The thickness of the strikeface 128 can be the same as the depth of the step 120 to fit the strikeface 128 within the step and overall cavity 118. The thickness of the strikeface 128 can be between 0.050 and 0.250 inches. The depth of the step 120 can be 0.050 inches, 0.075 inches, 0.100 inches, 0.125 inches, 0.150 inches, 0.175 inches, 0.200 inches, 0.225 inches, or 0.250 inches.

By connecting the strikeface 128 to the step 120 and the protrusion 122, a gap 138 is created between the cavity 118 and the rear surface 136 of the strikeface 128. The gap 138 extends continuously around the protrusion 122, and between protrusion 122 and step 120, so that strikeface rear surface 136 is only in contact with front portion 110 at step 120 and protrusion 122. Gap 138 comprises gap height 140 and is measured from bottom surface of the cavity 118 to strikeface rear portion 132 at protrusion 122. Gap height 140 is approximately equal to protrusion height 126. In some embodiments, gap height 140 and/or protrusion height 126 can be between 0.02 and 0.50 inches. The height of the protrusion 126 can be 0.02 inches, 0.05 inches, 0.10 inches, 0.15 inches, 0.20 inches, 0.250 inches, 0.30 inches, 0.35 inches, 0.40 inches, or 0.45 inches. In other embodiments, the gap height 140 may be less than or equal to 0.07 inches, 0.10 inches, 0.15 inches, 0.20 inches, 0.250 inches, 0.30 inches, 0.35 inches, 0.40 inches, or 0.45 inches.

Further, while gap 138 is depicted as void of any material, the embodiments are not limited in this regard. For example, the gap 138 may include a vibration attenuating feature disposed in gap 138 to reduce noise, to produce a more desirable sound, and to reduce vibration of the golf club head. The vibration attenuating feature can be composed of any material or composition capable of damping or removing vibrations such as damping foil, rubber, foam, elastic polymer, viscoelastic polymer, or pressure sensitive viscoelastic acrylic polymer. The vibration attenuating feature may be pressure sensitive, leading to lessening or removal of vibration from the golf club head when a golf ball is struck. The viscoelastic damping feature provides the golf club head with a more desirable sound combined with getting greater performance in a thin-face golf club head. Additionally, the vibration attenuating feature may be used for the purposes reinforcement or support along with the protrusion 122.

Golf club head rear portion 112 comprises the outer surface 114 having a wall 142 defining a recess 144. The wall 142 includes an interior surface 146 and the outer surface 114. The interior surface 146 may, in some embodiments, surround a portion of protrusion 122. The wall 142 includes a cross-sectional shape and cross-sectional area. The cross-sectional shape of the wall 142 may be in the form of a triangle, rectangle, semicircle or any other suitable geometric shape. The cross-sectional shape of the wall 142 may be constant or may vary along the wall. Likewise, the cross-sectional area of the wall 142 may be constant or may vary along the wall. For example, the thickness of the wall 142 may vary from the base to the top of the wall and may further vary along the wall. In other embodiments, the cross-sectional shape and cross-sectional area may remain constant along the wall.

Coupling strikeface 128 to front portion 110 at step 120 and protrusion 122, means a golf ball, when struck, will travel a more consistent distance regardless of where the impact occurs on the strikeface 128. When a golf ball is struck in the center of strikeface 128, protrusion 122 supports strikeface rear portion 132, thereby substantially reducing deflection and rebound of the center portion of strikeface 128. By reducing the deflection and rebound of a center portion of strikeface 128, energy transfer is reduced, corresponding to a shorter ball flight distance. Likewise, when a golf ball is strike on strikeface perimeter 130, step 120 supports strikeface rear portion 132, thereby substantially reducing deflection and rebound of strikeface perimeter 130. By reducing the deflection and rebound of strikeface perimeter 130, energy transfer is reduced corresponding to a shorter ball flight distance. Gap 138 can be tailored in order to allow an approximately equal amount of deflection and rebound at a center portion of strikeface 128, strikeface perimeter 130 and the area defined therebetween. Accordingly, energy transfer to the golf ball is roughly equivalent throughout the entire surface of strikeface 128, thereby resulting in a consistent ball flight distance.

Figure 4:
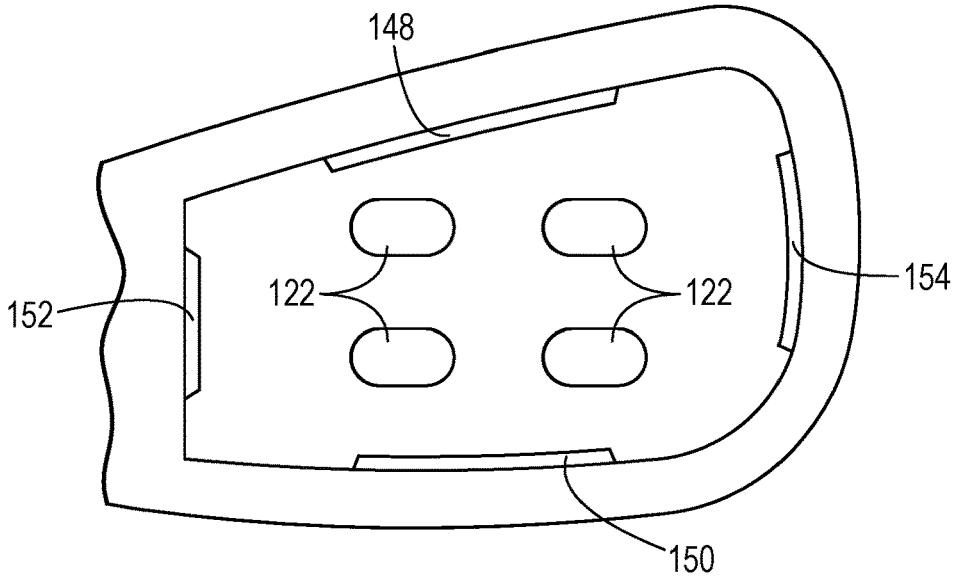
FIG. 4 illustrates a front view of an embodiment of an iron-type golf club with a floating perimeter strikeface.

Turning to FIG. 4, an alternative embodiment can include multiple protrusions 122 spaced throughout front portion 110. By spacing multiple protrusions throughout front portion 110, the area and mass of each protrusion 122 can be minimized and used to distribute mass elsewhere in the club. The multiple protrusions 122 can achieve a similar effect to the protrusion 122 found in the embodiments of FIGS. 1-3. The protrusions 122 can reduce the deflection and rebound of selected portions of the strikeface 128, thereby resulting in a consistent energy transfer to the golf ball. While the current embodiment is depicted with four protrusions 122, the embodiments are not limited in this regard. For example, other embodiments may comprise 2 protrusions, 3 protrusions, 5 protrusions, 6 protrusions, or any other number of protrusions.

In the same or different embodiments, step 120 can extend along the entire length of the perimeter 116 or along discrete portions of the perimeter 116. For example, in the current embodiment, the step 120 is depicted as four discrete segments: top step segment 148, bottom step segment 150, heel step segment 152, and toe step segment 154 of perimeter 116. However, in other embodiments the step 120 can extend along other portions of the perimeter 116. For example, the step 120 may extend between the top step segment 148 and the heel step segment 152, the heel step segment 152 and the bottom step segment 150, the bottom step segment 150 and the toe step segment 154, or the toe step segment 154 and the top step segment 148. Further, the number of step segments are not limited in this regard. Other embodiments may include 2 step segments, 3 step segments, 5 step segments, 6 step segments, or any other number of step segments. Protrusions 122 and step segments 148, 150, 152, and 154 can be positioned equidistance relative to each other in order to provide a consistent deflection and rebound of the strikeface 128.

The method of manufacturing golf club head 100 is merely exemplary and is not limited to the embodiments presented herein. The method can be employed in many different embodiments or examples not specifically depicted or described herein. In some embodiments, the processes of the method described can be performed in any suitable order. In other embodiments, the method 1000 may include additional processes. In other embodiments one or more processes may be combined, separated, or skipped.

Golf club head 100 may be manufactured by casting, forging, machining, rapid prototyping, layer-by-layer printing, selective laser sintering, direct metal laser sintering, stereolithography, or any other method. Similarly, strikeface 128 may be manufactured by casting, forging, machining, rapid prototyping, layer-by-layer printing, selective laser sintering, direct metal laser sintering, stereolithography, or any other method. Strikeface 128 and golf club head may be assembled by swaging, welding, brazing, adhesive, mechanical fit or any other method capable of coupling strikeface 128 to golf club head 100.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with an iron-type golf club, the apparatus, methods, and articles of manufacture described herein may be applicable to other types of golf club such as a fairway wood-type golf club, a hybrid-type golf club, a driver-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents Clause 1: A golf club head comprising a body having a front portion, a rear portion opposite the front portion, a toe portion, a heel potion opposite the toe portion, a top portion, a bottom portion opposite the top portion, a cavity region on the front portion, a protrusion and a step in the cavity region, a strikeface including a strikeface front portion, a strikeface rear portion, a strikeface perimeter portion and a strikeface center portion, wherein the strikeface rear portion is attached to the front portion by mating the strikeface perimeter portion to the step and the strikeface center portion to the protrusion; and a gap exists between the front portion and the strikeface rear portion, the gap surrounding the protrusion on all sides.

Clause 2: The golf club head of clause 1, wherein the strikeface further comprises a plurality of grooves on the strikeface front portion.

Clause 3: The golf club head of clause 1, further comprising a recess surrounded by a wall on the rear portion of the golf club head.

Clause 4: The golf club head of clause 3, wherein the wall at least partially surrounds a portion of the protrusion.

Clause 5: The golf club of clause 3, wherein a wall cross-sectional area varies throughout a length of the wall.

Clause 6: The golf club head of clause 1, further comprising a center of gravity a CG plane extending through the center of gravity, wherein the CG plane extends in a direction from the front portion to the rear portion and is orthogonal to the strikeplate and wherein the protrusion is positioned along the CG plane.

Clause 7: The golf club head of clause 1, wherein the protrusion is positioned an equal distance from the step nearest the toe portion as the step nearest the heel portion.

Clause 8: The golf club head of clause 1, wherein the protrusion is positioned an equal distance from the step nearest the top portion as the step nearest the bottom portion.

Clause 9: The golf club head of clause 1, wherein the gap is filled with a vibration attenuating feature comprising one of a damping foil, rubber, foam, elastic polymer, viscoelastic polymer, or pressure sensitive viscoelastic acrylic polymer.

Clause 10: The golf club head of clause 1, wherein the cavity is between 0.07 inches to 0.50 inches, and the protrusion is between 0.02 inches and 0.50.

Clause 11: A golf club head comprising a body having a front portion, a rear portion opposite the front portion, a toe portion, a heel potion opposite the toe portion, a top portion, a bottom portion opposite the top portion; a cavity region on the front portion; a step in the cavity region; a plurality of protrusions positioned within the cavity region; a strikeface including a strikeface front portion, a strikeface rear portion, a strikeface perimeter portion and a strikeface center portion; wherein the strikeface rear portion is attached to the front portion by mating the strikeface to the step and to the plurality of protrusions and a gap exists between the front portion and the strikeface rear portion, the gap surrounding each of the plurality of protrusions on all sides.

Clause 12: The golf club head of clause 11, wherein the strikeface further comprises a plurality of grooves on the strikeface front portion.

Clause 13: The golf club head of clause 11, further comprising a recess surrounded by a wall on the rear portion of the golf club head.

Clause 14: The golf club head of clause 13, wherein the wall at least partially surrounds a portion of one of the plurality of protrusions.

Clause 15: The golf club of clause 13, wherein: a wall cross-sectional area varies throughout a length of the wall.

Clause 16: The golf club head of clause 13, wherein a wall cross-sectional thickness varies throughout the length of the wall.

Clause 17: The golf club head of clause 11, further comprising a center of gravity; a CG plane extending through the center of gravity, wherein the CG plane extends in a direction from the front portion to the rear portion and is orthogonal to the strikeplate; and wherein a geometrical center of the plurality of protrusion is positioned along the CG plane.

Clause 18: The golf club head of clause 11, wherein a geometrical center of the plurality of protrusions is positioned an equal distance from the step nearest the toe portion as the step nearest the heel portion.

Clause 19: The golf club head of clause 11, wherein a geometrical center of the plurality of protrusions is positioned an equal distance from the step nearest the top portion as the step nearest the bottom portion.

Clause 20: The golf club head of clause 11, wherein the cavity is between 0.07 inches to 0.50 inches, and each of the plurality of protrusions is between 0.02 inches and 0.50.

Various features and advantages of the disclosure are set forth in the following claims.

The invention claimed is:

1. A golf club head comprising: a body having a front portion, a rear portion opposite the front portion, a toe portion, a heel potion opposite the toe portion, a top portion, a bottom portion opposite the top portion; a cavity region on the front portion, wherein the cavity region comprises a depth measured from the front portion of the body, wherein the depth of the cavity region is between 0.07 inch and 0.50 inch, a protrusion and a step in the cavity region, wherein the step comprises a depth measured from the front portion of the body, wherein the depth of the step is between 0.050 inch and 0.250 inch, wherein the depth of the cavity region is always greater than the depth of the step, wherein the protrusion comprises a height measured from the cavity region surface, wherein the body comprises a first material, wherein the protrusion and the step consist of the first material of the body, a strikeface including a strikeface front portion, a strikeface rear portion, a strikeface perimeter portion and a strikeface center portion, wherein the strikeface rear portion is attached to the front portion by mating the strikeface perimeter portion to the step and the strikeface center portion to the protrusion, and wherein the height of the protrusion is the depth of the cavity minus the depth of the step such that a top surface of the protrusions sits flush with or connects to the strikeface rear portion, a gap exists between the front portion and the strikeface rear portion, the gap surrounding the protrusion on all sides, wherein the golf club head comprises a CG plane from the front portion to the rear portion, wherein the CC plane is orthogonal to the strikeface, wherein the protrusion is positioned along the CG plane.

2. The golf club head of claim 1, wherein the strikeface further comprises a plurality of grooves on the strikeface front portion.

3. The golf club head of claim 1, further comprising a recess surrounded by a wall on the rear portion of the golf club head.

4. The golf club head of claim 3, wherein the wall at least partially surrounds a portion of the protrusion.

5. The golf club of claim 3, wherein a wall cross-sectional area varies throughout a length of the wall.

6. The golf club head of claim 1, further comprising:

a center of gravity;

a CG plane extending through the center of gravity, wherein the CG plane extends in a direction from the front portion to the rear portion and is orthogonal to the strikeplate; and wherein the protrusion is positioned along the CG plane.

7. The golf club head of claim 1, wherein the protrusion is positioned an equal distance from the step nearest the toe portion as the step nearest the heel portion.

8. The golf club head of claim 1, wherein the protrusion is positioned an equal distance from the step nearest the top portion as the step nearest the bottom portion.

9. The golf club head of claim 1, wherein the gap is filled with a vibration attenuating feature comprising one of a damping foil, rubber, foam, elastic polymer, viscoelastic polymer, or pressure sensitive viscoelastic acrylic polymer.

10. The golf club head of claim 1, wherein the cavity is between 0.07 inches to 0.50 inches, and the protrusion is between 0.02 inches and 0.50.

* * * * *